US006781480B1

(12) United States Patent
Kim et al.

(10) Patent No.: US 6,781,480 B1
(45) Date of Patent: Aug. 24, 2004

(54) DUPLEXER DIELECTRIC FILTER HAVING AN OPEN AREA ONLY IN THE RECEPTION AREA OF THE DUPLEXER

(75) Inventors: Byung Taek Kim, Ansan-si (KR); Byoung HWA Lee, Seongnam-si (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/645,254

(22) Filed: Aug. 24, 2000

(30) Foreign Application Priority Data

Aug. 25, 1999 (KR) ..... 1999-35408

(51) Int. Cl.[7] ..... H01P 1/213; H01P 1/205
(52) U.S. Cl. ..... 333/134; 333/202; 333/206
(58) Field of Search ..... 333/134, 206, 333/202, 202 DB

(56) References Cited

U.S. PATENT DOCUMENTS 5,146,193 A * 9/1992 Sokola ..... 333/206
5,239,279 A * 8/1993 Turunen et al. ..... 333/134
5,250,916 A * 10/1993 Zakman ..... 333/134 X
5,721,520 A * 2/1998 McVeety et al. ..... 333/206 X
5,831,495 A * 11/1998 Hino ..... 333/202
6,229,410 B1 * 5/2001 Lee et al. ..... 333/206

* cited by examiner

*Primary Examiner*—Benny Lee
(74) *Attorney, Agent, or Firm*—Renner, Otto, Boisselle & Sklar, LLP

(57) ABSTRACT

A duplexer dielectric filter is disclosed. This filter has a dielectric block, with reception and transmission areas formed on the dielectric block and respectively having a resonator formed by a resonating hole. This resonating hole is at least partially coated with a conductive material on its internal surface. Reception and transmission terminals are formed on the upper and side surfaces of the dielectric block at positions corresponding to the reception and transmission areas and are insulated from the conductive material of the side surface of the dielectric block. An antenna terminal is arranged between the reception and transmission areas. An open area, free from a conductive material, is formed on at least a part of the side surface of the dielectric block at a position corresponding to the reception area. This open area controls both the coupling capacitance and the loading capacitance of the resonators since the loading capacitance and the coupling capacitance are changed in accordance with the size of the open area. The open area may be formed on the side surface of the dielectric block at one position or may be formed at a plurality of positions corresponding to the resonators within the reception area.

11 Claims, 7 Drawing Sheets

DUPLEXER DIELECTRIC FILTER HAVING AN OPEN AREA ONLY IN THE RECEPTION AREA OF THE DUPLEXER

BACKGROUND OF THE INVENTION

1. Field of the Invention

The present invention relates, in general, to duplexer dielectric filters and, more particularly, to a duplexer dielectric filter having an open area free from a conductive layer on the side surface of a dielectric block within a reception area, thus reducing the loading capacitance and increasing the coupling capacitance between neighboring resonators, and thereby producing a desired small-sized duplexer dielectric filter.

2. Description of the Prior Art

As is well known to those skilled in the art and the general public, mobile communication systems using super high frequency band waves have been largely substituted for conventional wire communication systems. Therefore, cellular phones are widely used and are subjected to active research and development to improve their operational performance and achieve the desired compactness, smallness and lightness thereof.

A duplexer filter is designed to commonly transmit and receive signals using one antenna at the same time. Such a duplexer filter comprises a reception filter and a transmission filter. The reception filter passes reception frequency components, but suppresses transmission frequency components. On the other hand, the transmission filter passes transmission frequency components, but suppresses reception frequency components. In order to use such duplexer filters in cellular phones, it is necessary that said duplexer filters be made to occupy a very small space. Such an object may be accomplished by integrated duplexer dielectric filters.

FIG. 1 is a perspective view showing the construction of a conventional integrated duplexer dielectric filter. As shown in the drawing, the conventional integrated duplexer dielectric filter comprises a dielectric block 1 having a generally cubic-shape. This duplexer dielectric filter has two filtering areas: a transmission area 10 and a reception area 20. The dielectric block 1 has an upper surface 3, a lower surface, and a side surface 5. A conductive material is coated on the lower surface and the side surface 5. A series of resonating holes 7 are regularly and parallely formed in the dielectric block 1 in such a way that the holes 7 completely extend from the upper surface 3 to the lower surface and are spaced apart from each other at regular intervals. The resonating holes 7 are entirely coated with a conductive material on their internal surfaces, thereby forming desired resonators.

A conductive pattern 9, having a predetermined size, is formed on the upper surface 3 of the dielectric block 1 at a position around each of the resonating holes 7. Such conductive patterns 9 are connected to the conductive layers on the internal surfaces of the resonating holes 7, thus forming a loading capacitance between the resonating holes 7 and the conductive layer of the side surface 5, and forming a coupling capacitance between neighboring resonators. The resonance frequency of the resonators is determined by both the resonating holes 7 and the loading capacitance, while the coupling capacitance couples the resonators to each other. The transmission area 10 and the reception area 20 of the upper and side surfaces 3 and 5 of the dielectric block 1 are provided with transmission and reception-terminals 12*a* and 12*b* for accomplishing the signal transmission and reception operation. An antenna terminal 12*c*, consisting of a conductive pattern, is formed at a position between the transmission and reception areas 10 and 20. The transmission terminal 12*a*, the reception terminal 12*b* and the antenna terminal 12*c* are insulated from the conductive material disposed on the side surface 5 of the dielectric block by open areas 14*a*, 14*b* and 14*c*, respectively.

FIG. 2 is an equivalent circuit diagram of the duplexer dielectric filter of FIG. 1. In FIG. 2, the reference character "R" denotes transmitting lines, each of which is always opened at one end thereof by an associated resonating hole 7 of the dielectric block 1. As described above, he antenna terminal is disposed between the transmission area and the reception area. The elements related to the resonating holes 7 within the transmission area are indicated by the reference labels including the character "t", for example, Cti, Ctij, Rti and Mtij, while the elements related to the resonating holes 7 within the reception area are indicated by the reference labels including the character "r", for example, Cri, Crij, Rri and Mrij. The loading capacitance Cti, Cri (i=1, 2, 3), formed between the resonating holes 7 and the conductive layer on the side surface 5 of the dielectric block 1, is connected to the open ends of the signal transmitting lines. A desired resonating circuit is formed by both the signal transmitting lines Rti, RH (i=1, 2, 3) and the loading capacitance.

In a conventional duplexer dielectric filter, it is necessary to accomplish both desired signal transmitting characteristics within a transmission frequency band and desired attenuation characteristics within a low frequency band. The desired transmission characteristics within the transmission frequency band are determined by a coupling of the resonance frequency of the resonators, determined by both the signal transmitting lines Rti, Rri and the loading capacitance Cti, Cri, the coupling capacitance Ctij, Crij (i,j=1, 2, 3), and electromagnetic coupling values Mtij, Mrij (i,j=1, 2, 3). The desired attenuation characteristics within the low frequency band are determined by a coupling. That is, both the attenuation characteristics and the frequency of an attenuation pole are determined by a combination of the coupling capacitance and magnetic coupling values.

In the conventional duplexer dielectric filters, the high frequency band within the transmission area is relatively lower than that of the reception area. Therefore, the electric field effect between the resonating holes is relatively higher within the reception area than that of the transmission area, but the magnetic field effect between the resonating holes is relatively higher in the transmission area than that of the reception area. Therefore, the resonators within the reception area form a capacitance coupling, but the resonators within the transmission area form an inductance coupling.

In such a conventional duplexer dielectric filter of FIG. 1, the determination of the resonance frequency or the coupling between the resonators are changed in accordance with the size of the conductive patterns 9 formed on the upper surface 3 of the dielectric block 1. In other words, the operational characteristics of the duplexer the dielectrc filters are changed in accordance with both the gap between the conductive patterns 9 and the conductive layer of the side surface 5, and the gap between the conductive patterns 9.

As described above, in order to determine the resonance frequency of the duplexer dielectric filter, it is necessary to control the distance between the conductive patterns 9, formed on the upper surface 3 of the dielectric block 1, and the conductive layer formed on the side surface 5 of the dielectric block 1. However, in a conventional duplexer dielectric filter, the resonance frequency within the transmission area is lower than that of the reception area, and so it is necessary to make the loading capacitance within the transmission area higher than that of the reception area. In order to form a high loading capacitance within the transmission area, it is necessary to enlarge the size of the conductive patterns 9 within the transmission area and to complicate the arrangement of those conductive patterns 9.

The length of the signal transmitting lines within the transmission area 10 is equal to that of the reception area 20, and so it is necessary to properly control both the loading capacitance and the coupling capacitance so as to accomplish the desired filtering characteristics of the duplexer dielectric filter. Such a capacitance may be properly controlled by changing the pattern and size of the conductive patterns 9. When the size of the dielectric block 1 is reduced to achieve the desired compactness, smallness and lightness of the duplexer dielectric filter, the following problems may be generated:

When forming the conductive patterns 9 through a screen printing process that is the most typical process, the line width or the line interval is about 150 $\mu$m. The maximum loading capacitance is thus undesirably reduced in accordance with a reduction in the printed area for the conductive patterns 9 during such a screen printing process. Therefore, in the case of the transmission terminal, it is necessary to lengthen the signal transmitting line R so as to maintain the loading capacitance at a preset level, although it is desired to reduce the size of the duplexer dielectric filter.

On the other hand, the length of the signal transmitting lines within the reception area 20 is equal to that of the transmission area 10, and so the resonance frequency of the signal transmitting line is reduced in inverse proportion to the length of the signal transmitting line. In such a case, the size of the conductive patterns is reduced. Since the size of the conductive patterns within the reception area is smaller than that of the transmission area due to the coupling capacitance, there is a limit to the possible reduction in the size of the conductive patterns within the reception area. For example, when using a dielectric block that is thinner than a conventional dielectric block, the resonance frequency of the signal transmitting line is reduced, but the gap between the conductive patterns is increased due to the reduction in the size of the conductive patterns. This finally reduces the coupling capacitance. Therefore, it is almost impossible to form a coupling capacitance having a desired value. When the dielectric block is reduced in thickness, the length of the signal transmitting line is increased in accordance with the preset loading capacitance. This finally reduces the market competitiveness of the resulting duplexer dielectric filter, since the production cost of such filters is undesirably increased.

SUMMARY OF THE INVENTION

Accordingly, the present invention has been made keeping in mind the above problems occurring in the prior art, and an object of the present invention is to provide a duplexer dielectric filter, which has an open area free from a conductive layer on the side surface of a dielectric block within a reception area, thus properly controlling both the loading capacitance and the coupling capacitance of a resonator.

Another object of the present invention is to provide a duplexer dielectric filter, which has an open area free from a By conductive layer on the side surface of a dielectric block within a reception area, thus reducing the loading capacitance and increasing the coupling capacitance, and thereby producing a desired small-sized and light duplexer dielectric filter.

In order to accomplish the above object, the present invention provides a duplexer dielectric filter, comprising: a dielectric block having an upper surface, a lower surface, and a side surface, with a conductive material coated on at least a part of the lower and side surfaces; a reception area for filtering a received signal, the reception area comprising at least one resonator including a resonating hole, the resonating hole completely extending from the upper surface to the lower surface of the dielectric block while being at least partially coated with a conductive material on its internal surface; a transmission area for filtering a signal to be transmitted, the transmission area comprising at least one resonator including a resonating hole, the resonating hole completely extending from the upper surface to the lower surface of the dielectric block while being at least partially coated with a conductive material on its internal surface; a transmission terminal for accomplishing a signal transmission operation, the transmission terminal comprising an electrode area formed on the upper and side surfaces of the dielectric block at a position corresponding to the transmission area while being insulated from the conductive material coated on the side surface of the dielectric block; a reception terminal for accomplishing a signal reception operation, the reception terminal comprising an electrode area formed on the upper and side surfaces of the dielectric block at a position corresponding to the reception area while being insulated from the conductive material coated on the side surface of the dielectric block; an antenna terminal arranged between the reception and transmission areas and comprising an electrode area insulated from the conductive material coated on the side surface of the dielectric block; and an open area formed on at least a part of the side surface of the dielectric block at a position corresponding to the reception area while being free from a conductive material, the open area controlling both a coupling capacitance and a loading capacitance of the resonators.

In the above duplexer dielectric filter, the loading capacitance and the coupling capacitance is changed in accordance with the size of the open area defining the gap between the ground electrode and the resonators. The open area may be formed on the side surface of the dielectric block at one position or may be formed at a plurality of positions corresponding to the resonators within the reception area.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 3:
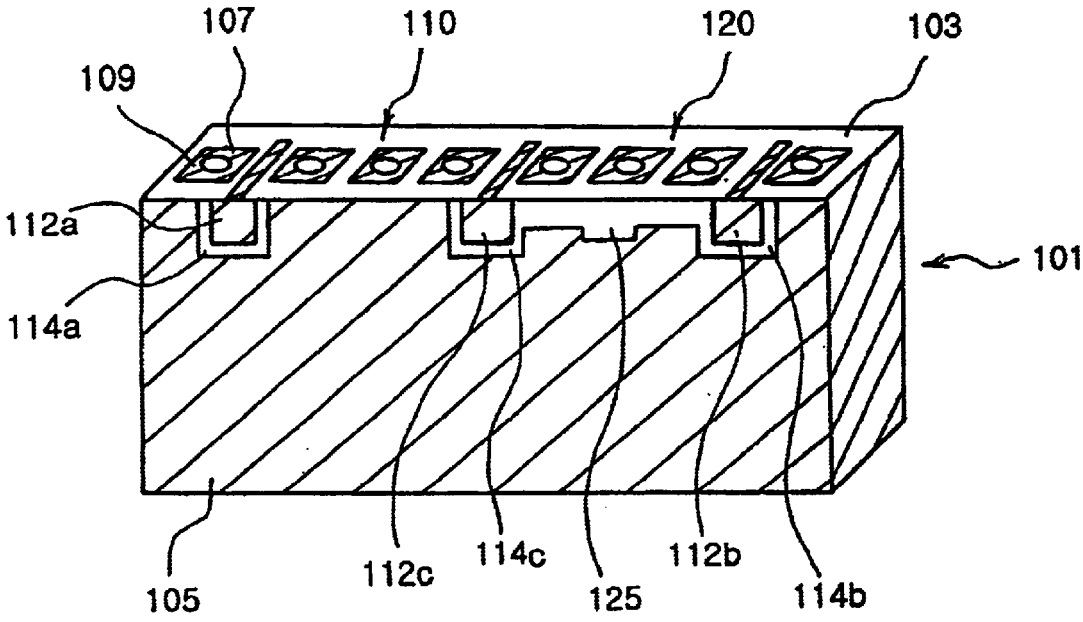
FIG. 3 is a perspective view showing the construction of a duplexer dielectric filter in accordance with the primary embodiment of the present invention.

FIG. 3 is a perspective view showing the construction of a duplexer dielectric filter in accordance with the primary embodiment of the present invention. As shown in the drawing, the duplexer dielectric filter according to the present invention comprises a dielectric block 101 having a generally cubic-shape. The dielectric block 101 has an upper surface 103, a lower surface, and a side surface 105. A series of resonating holes 107 are regularly and parallely formed in the dielectric block 101 in such a way that the holes 107 completely extend from the upper surface 103 to the lower surface and are spaced apart from each other at regular intervals. A conductive material is coated on at least a part of the side surface 105 between the upper surface 103 and the lower surface, thus forming a ground electrode. The resonating holes 107 are also coated with a conductive material on at least a part of their internal surfaces, thereby forming resonators. The upper surface 103 is provided with an open area free from such a conductive material.

At least one conductive pattern 109, having a predetermined size, is formed on the upper surface 103 of the dielectric block 101 at a position around each of the resonating holes 107. Such conductive patterns 109 are connected to the conductive layers on the internal surfaces of the resonating holes 107, thus forming loading capacitance between the resonating holes 107 and the conductive layer of the side surface 105 and forming coupling capacitance between neighboring resonators. The upper and side surfaces 103 and 105 of the dielectric block 101 are provided with transmission and reception terminals 112*a* and 112*b* for accomplishing the transmission and reception operation in addition to an antenna terminal 112*c*. The transmission terminal 112*a*, the reception terminal 112*b* and the antenna terminal 112*c* are insulated from the conductive material disposed on the side surface 5 of the dielectric block by open areas 114*a*, 114*b* and 114*c*, respectively.

The duplexer dielectric filter of this invention has two filtering areas: a reception area and a transmission area.

In the embodiment of FIG. 3, the three resonating holes, formed in the dielectric block at the left-hand side of the antenna terminal 112*c*, are included within the transmission area 110, at which high frequency signals are transmitted from the filter. On the other hand, the three resonating holes, formed in the dielectric block at the right-hand side of the antenna terminal 112*c*, are included within the reception area 120, at which high frequency signals are received into the filter. Of course, it is not necessary to limit the number of the resonating holes within each filtering area. Of the two filtering areas, the reception area 120 passes the reception frequency components, but suppresses the transmission frequency components. On the other hand, the transmission area 110 passes the transmission frequency components, but suppresses the reception frequency components.

An open area 125 free from any conductive layer is formed on the side surface 105 of the dielectric block 101 within the reception area 120 and is integrated with the other open areas 114*b* and 114*c*. The open area 125 controls both the loading capacitance formed between the conductive patterns 109 within the reception area 120 and the ground electrode of the side surface 105 and the coupling capacitance between the conductive patterns 109. The control of both the loading capacitance and the coupling capacitance will be described in detail as follows, with reference to FIGS. 5A and 5B.

Figure 5A:
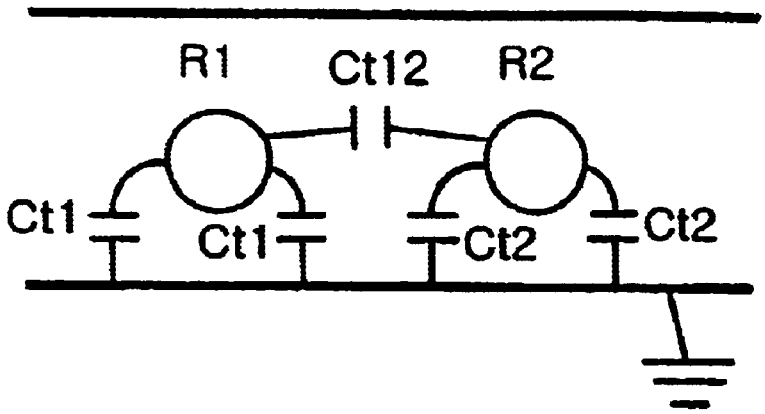
FIGS. 5A and 5B are views showing the values of both the loading capacitance and the coupling capacitance when forming an open area on the dielectric block of the filter.
Figure 5B:
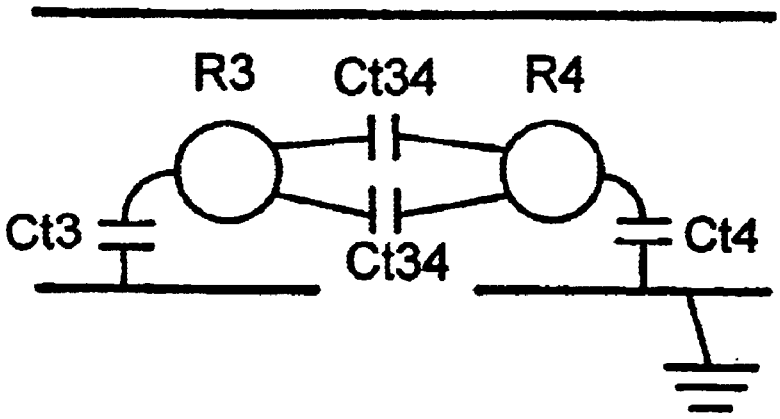

Similar to the transmission area of the duplexer dielectric filter as shown in FIG. 3, when two resonators R1, R2 are formed between the ground electrodes in the same manner as expected from a conventional duplexer dielectric filter as shown in FIG. 5A, a loading capacitance Ct1, Ct2 (Ct1 is a random value) is formed between the resonators R1, R2 and the ground electrodes. In addition, a coupling capacitance Ct12 (Ct12 is a random value) is formed between the resonators R1, R2. On the other hand, similar to the reception area of the duplexer dielectric filter as shown in FIG. 3, when the ground electrode is partially open as expected from the present invention as shown in FIG. 5B, a loading capacitance Ct3, Ct4 is formed between the resonators R3, R4 and the ground electrodes. In addition, a coupling capacitance Ct34 is formed between the resonators R3, R4.

When the open area 125 is formed on the side surface 105 of the dielectric block 101 as described above, the loading capacitance is reduced, but the coupling capacitance is increased. Such a reduction in the loading capacitance results in an increase in the size of the conductive patterns 109. Therefore, even when the thickness of the dielectric block 101 is reduced below a reference level due to a reduction in the loading capacitance, it is possible to form conductive patterns 109 having a desired size within the reception area 120. Therefore, even though the coupling capacitance is reduced due to an increase in the distance between the conductive patterns 109 in the duplexer dielectric filter of this invention, the coupling capacitance is increased due to the open area on the ground electrode. It is thus possible to accomplish a desired coupling capacitance.

The loading capacitance, formed between the conductive patterns 109 and the ground electrodes, is changed in accordance with the distance between the conductive patterns 109 and the ground electrodes. It is thus possible to control the loading capacitance of the resonating holes 107 by changing the distance between the ground electrodes and the resonating holes 107 within the reception area 120. This may be accomplished by changing the shape of the open area 125, for example, by forming a step on the open area 125 as shown in FIG. 3.

In the embodiment of FIG. 3, the open area 125 is formed on the front part of the side surface 105 of the dielectric block 101. However, it should be understood that the position of the open area 125 is not limited to the front part of the side surface 105. That is, the open area 125 may be formed on the rear part of the side surface 105 of the dielectric block 101. In such a case, the open area 125 performs the above-mentioned operational function, thus controlling the loading capacitance between the conductive patterns 109 and the ground electrodes. In other words, the open area 125 of this invention may be freely formed on any part of the side surface 105 of the dielectric block 101 at a position corresponding to the resonating holes. 107 within the reception area 120. The position of the open area 125 on the side surface 105 of the dielectric block 101 does not influence the operational function of the resulting duplexer dielectric filter of this invention. That is, the open area 125 of this invention may be formed on any part of the side surface 105 of the dielectric block 101 at a position corresponding to the resonating holes 107 within the reception area 120 without influencing the operational function of the resulting duplexer dielectric filter of this invention.

In addition, two open areas 125 may be formed on the side surface 105 at opposite positions corresponding to the resonating holes 107 within the reception area 120. In such a case, it is possible to desirably reduce the size of each open area 125, different from the embodiment having one open area 125 formed on only one part of the side surface 105. When two open areas 125 are formed on the side surface 105 at opposite positions corresponding to the resonating holes 107 within the reception area 120 as described above, it is possible to accomplish a desired high loading capacitance between the ground electrodes and the resonating holes while desirably reducing the size of the open area 125.

As described above, the shape of the open area 125 in the duplexer dielectric filter of this invention is not limited. In the primary embodiment of FIG. 3, the open area 125 is integrated with the open areas of both the reception terminal 112*b* and the antenna terminal 112*c*. However, the open area according to the present invention can be changed to various embodiments as shown in FIGS. 4A and 4B.

Figure 4A:
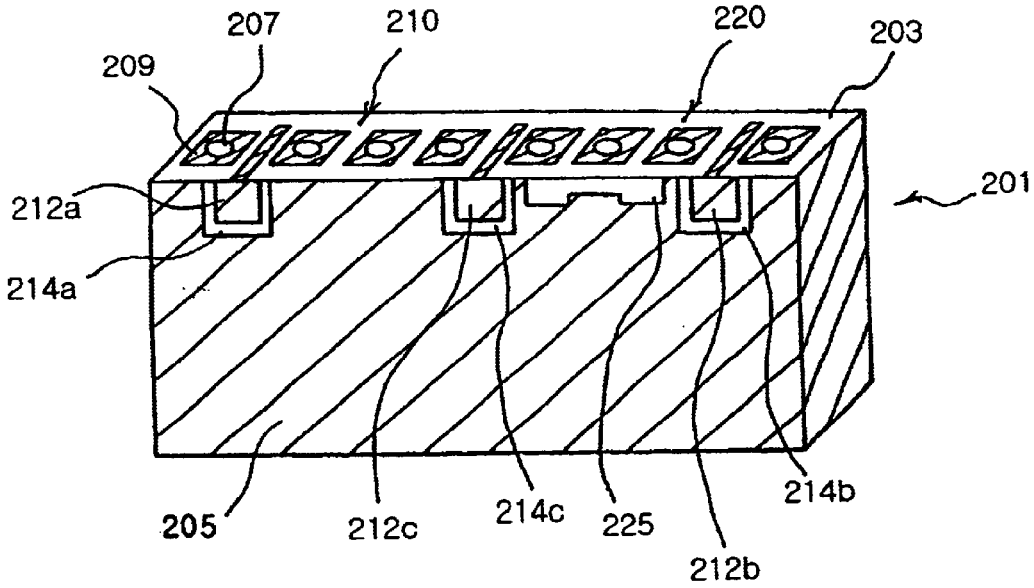
FIGS. 4A and 4B are perspective views, respectively showing the construction of duplexer dielectric filters in accordance with the second and third embodiments of the present invention.
Figure 4B:
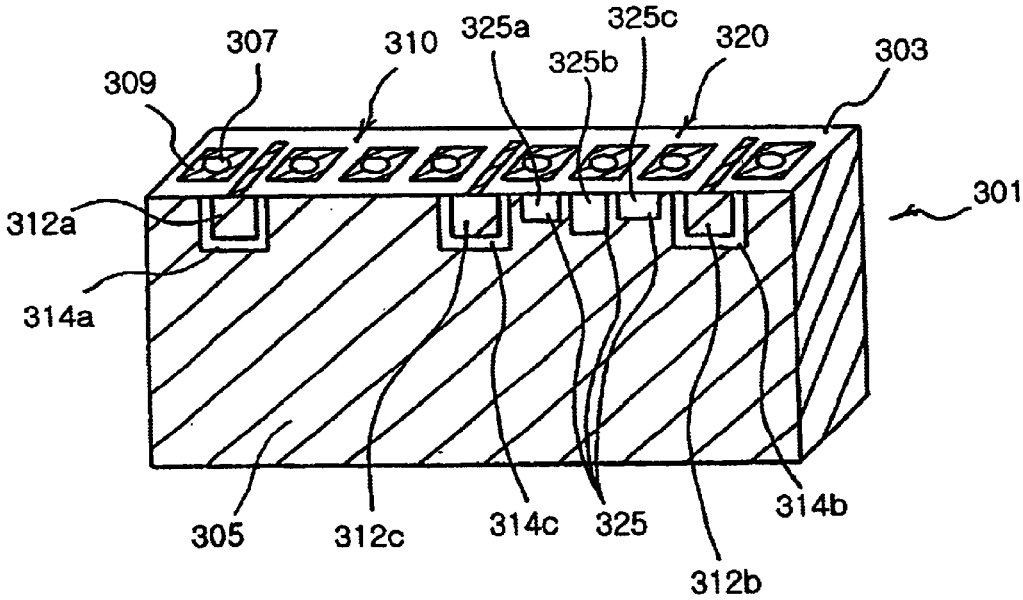

Referring to FIG. 4A, the dielectric block 201 has ad upper surface 203, a lower surface (not shown), and a side surface 205. A series of resonating holes 207 are formed in the dielectric block 201. A conductive material is coated on at least a part of the side surface 205 between the upper surface 203 and the lower surface, thus forming a ground electrode. The resonating holes 207 are also coated with a conductive material on at least a part of their internal surfaces, thereby forming resonators. The upper surface 203 is provided with an open area free from such a conductive material.

At least one conductive pattern 209 is formed on the upper surface 203 of the dielectric block 201 at a position around each of the resonating holes 207 to be connected to the conductive layers on the internal surfaces of the resonating holes 207. The upper and side surfaces 203 and 205 of the dielectric block 201 are provided with transmission and reception terminals and an antenna terminal 212*c* 212*a* and 212*b*. The transmission terminal 212*a*, the reception terminal 212*b* and the antenna terminal 212*c* are insulated from the conductive material disposed on the side surface 205 of the dielectric block by open areas 214*a*, 214*b* and 214*c*, respectively. While three resonating holes 207. formed in the dielectric block 201 at the left-hand side of the antenna terminal 212*c*, are included within the transmission area 210, another three resonating holes 207 in the dielectric block 201 at the right-hand side of the antenna terminal 212*c*, are included within the reception area 220.

The duplexer dielectric filter, as shown FIG. 4A, includes the open area 225 disposed on the side surface at the position corresponding to the reception area 220 between the reception terminal 212*b* and the antenna terminal 212*c*, this being similar to the first embodiment of FIG. 3, but the open area 225 is isolated from the open areas of both the reception terminal 212*b* and the antenna terminal 212*c*.

The duplexer dielectric filter according to the third embodiment of the present invention, shown in FIG. 4B, includes a plurality of the open areas 325*a*, 325*b*, 325*c*.

Referring to FIG. 4B, similar to the duplexer dielectric filter of FIG. 4A, the duplexer dielectric filter comprises the dielectric block 301 having an upper surface 303, a lower surface (not shown), and a side surface 305. A series of resonating holes 307 are formed in the dielectric block 301. The resonating holes 307 are coated with a conductive material on at least a part of their internal surfaces to form resonators. At least one conductive pattern 309 is formed on the upper surface 303 at a position around each of the resonating holes 307. The transmission and the reception terminals and an antenna terminal 312*c*, 312*a* and 312*b*. are disposed on upper and side surfaces 303 and 305 of the dielectric block 301, and are insulated from the conductive material disposed on the side surface 305 of the dielectric block by open areas 314*a*, 314*b* and 314*c*, respectively. While the three resonating holes 307, formed in the dielectric block 301 at the left-hand side of the antenna terminal 312*c*, are included within the transmission area 310. another three resonating holes 307 at the right-hand side of the antenna terminal 312*c*, are included within the reception are 320.

The duplexer dielectric filter also comprises a number of open areas (325*a*. 325*b*. 325*c*) at positions corresponding to the conductive patterns 309 formed on the upper surface 303 of the dielectric block 301, which are isolated from each other as shown in FIG. 4B.

In the second and third embodiments, the open area 225 is not limited in its shape, but may be somewhat freely altered in shape while being spaced apart from the conductive patterns 209 by a desired distance. It is thus possible to form a desired loading capacitance. Particularly in the third embodiment of FIG. 4B, the desired loading capacitance may be more easily formed by making the sizes of the open areas (325*a*. 325*b*. 325*c*), corresponding to the conductive patterns 309, different from each other.

Figure 6A:
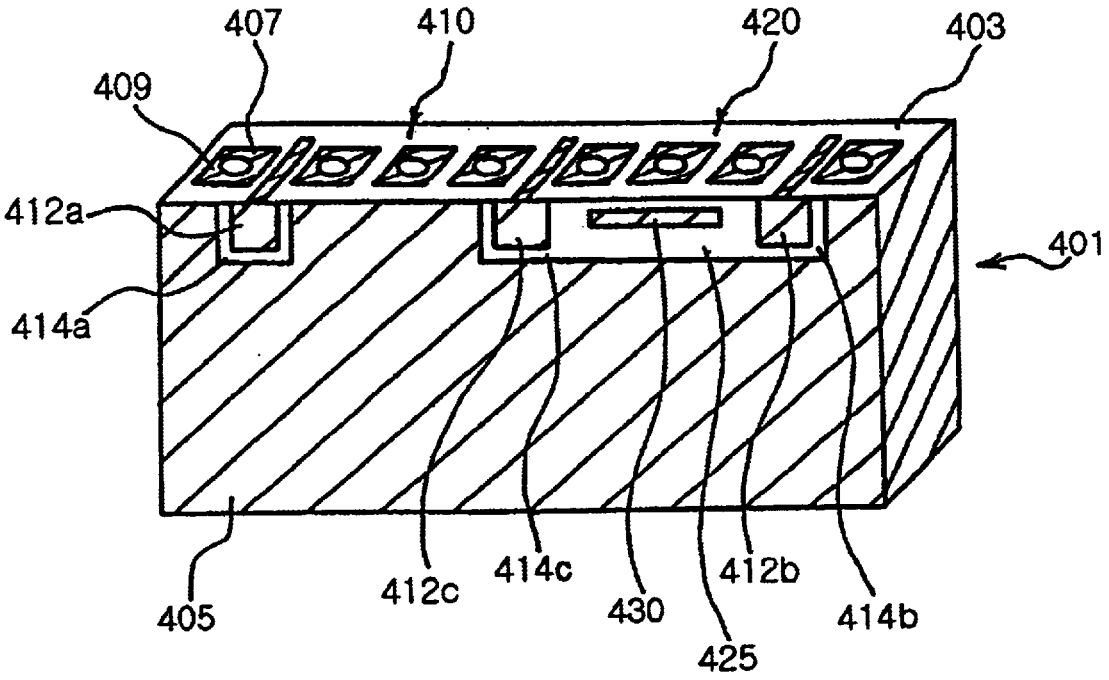
FIG. 6A is a perspective view showing the construction of a duplexer dielectric filter in accordance with the fourth embodiment of the present invention.
Figure 6B:
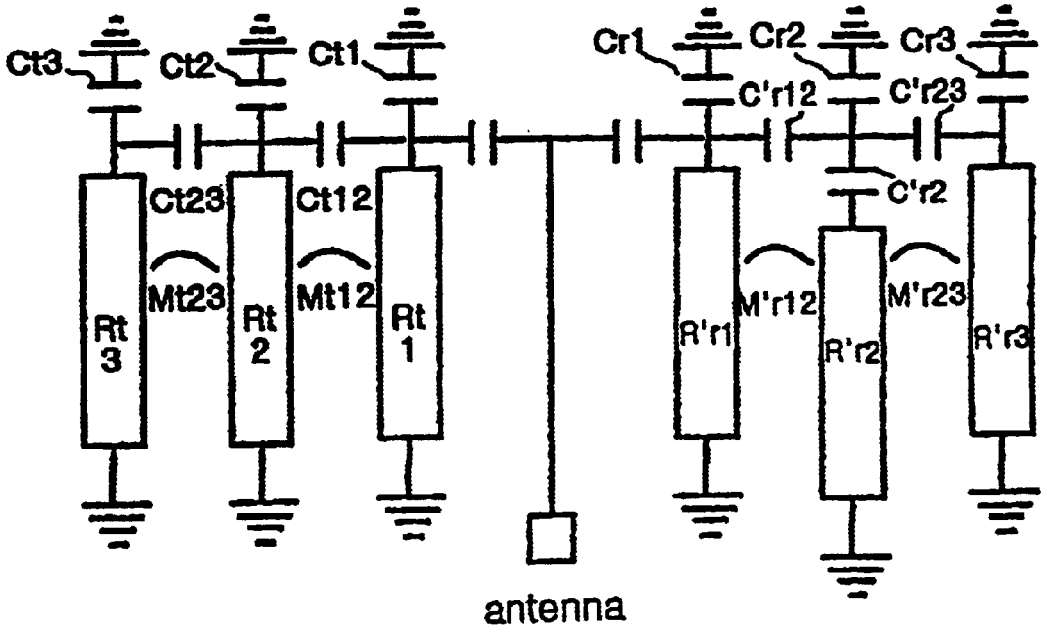
FIG. 6B is an equivalent circuit diagram of the duplexer dielectric filter of FIG. 6A.

FIG. 6A is a perspective view showing the construction of a duplexer dielectric filter in accordance with the fourth embodiment of the present invention. FIG. 6B is an equivalent circuit diagram of the duplexer dielectric filter of FIG. 6A. In the fourth embodiment, the general shape of the duplexer dielectric filter remains the same as that described for the primary embodiment of FIG. 3, but the structure of the open area 325 is altered (see FIG. 6A). Referring to FIG. 6A, the duplexer dielectric filter according to the fourth embodiment comprises the dielectric block 401 having an upper surface 403, a lower surface, and a side surface 405. A series of resonating holes 407 are formed in the dielectric block 401. The resonating holes 407 are coated with a conductive material on at least a part of their internal surfaces to form resonators. At least one conductive pattern 409 is formed on the upper surface 403 at a position around each of the resonating holes 407. The transmission and the reception terminals and an antenna terminal 412*c*, 412*a* and 412*b*. are disposed on upper and side surfaces 403 and 405 of the dielectric block 401, and are insulated from the conductive material disposed on the side surface 405 of the dielectric block by open areas 414*a*, 414*b* and 414*c*, respectively. While the three resonating holes 407, formed in the dielectric block 401 at the left-hand side of the antenna terminal 412*c*, are included within the transmission area 410, another three resonating holes 407 at the right-hand side of the antenna terminal 412*c*, are included within the reception are 420.

In the duplexer dielectric filter according to the fourth embodiment shown in FIG. 6A, an open area 425, having a predetermined size, is formed on the side surface 405 of the dielectric block 401 at a position corresponding to the resonating holes 407 within the reception area. A conductive pattern 430, having a predetermined length, is formed on the open area 425. In the fourth embodiment, the conductive pattern 430 extends in parallel to the side between the upper surface 403 and the side surface 405 of the dielectric block 401. However, it should be understood that the conductive pattern 430 may extend while being inclined to the side between the upper surface 403 and the side surface 405.

Figure 1:
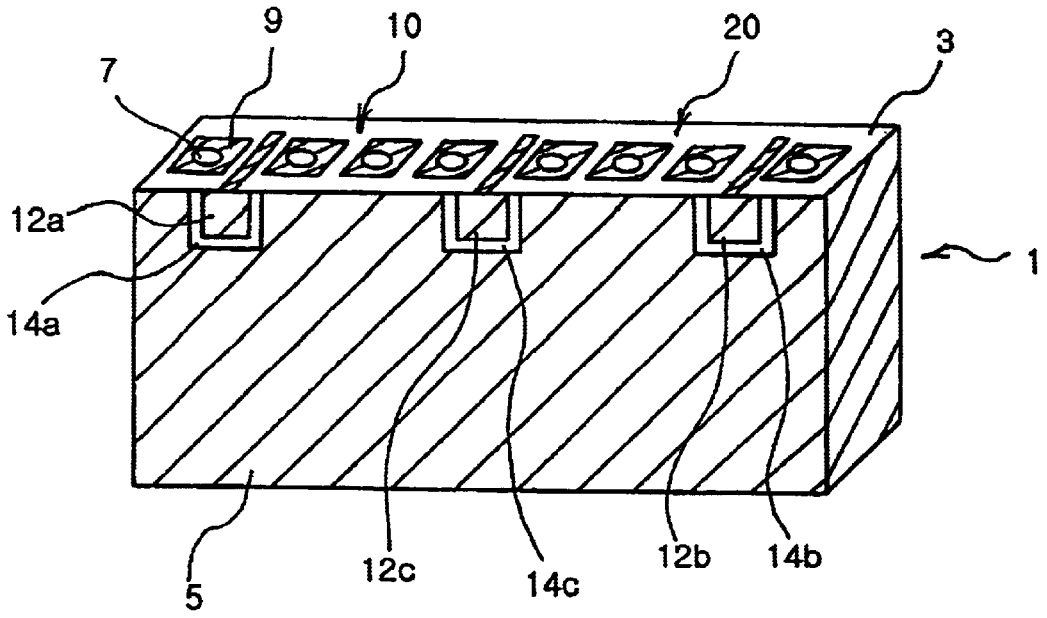
FIG. 1 PRIOR ART
FIG. 1 is a perspective view showing the construction of a conventional duplexer dielectric filter.
Figure 2:
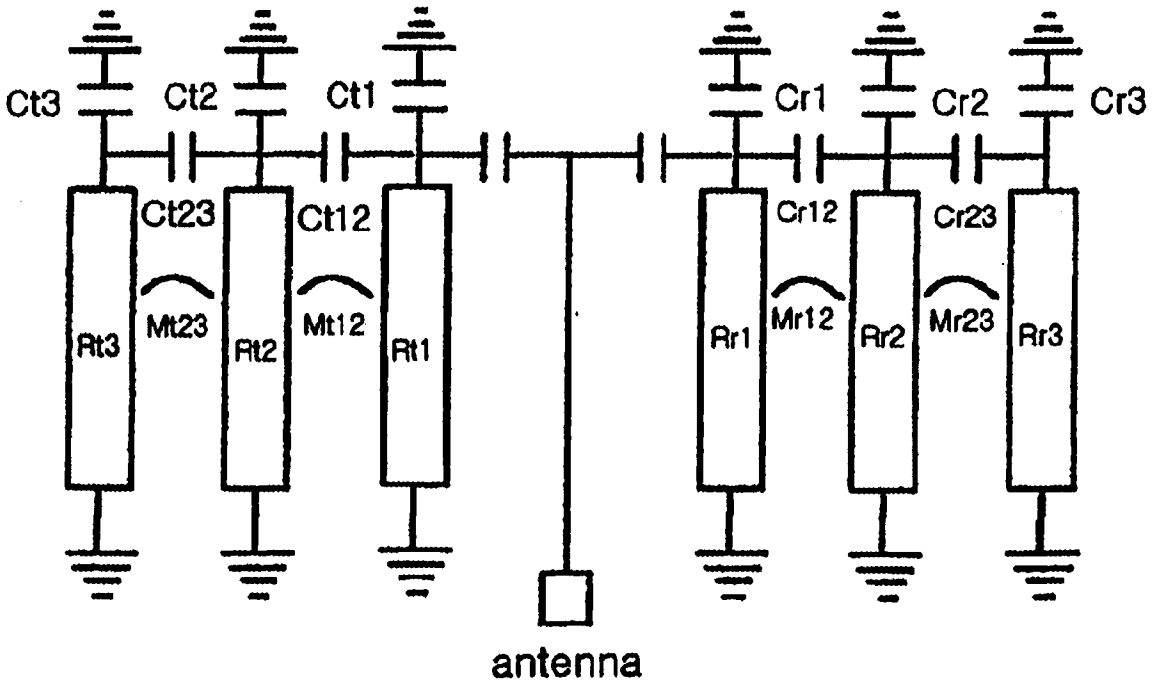
FIG. 2 PRIOR ART
FIG. 2 is an equivalent circuit diagram of the duplexer dielectric filter of FIG. 1.

As shown in the equivalent circuit diagram of FIG. 6B, the circuit part of the transmission area, including Cti(i=1, 2,3), Ct12 and Ct23, Rti(i=1,2,3), Cri(i=1,2,3) and Mt1.2 and Mt23 can be described as the one of the transmission area of FIG. 2. Correspondingly, C'r12 and C'r23 are the coupling capacitances between adjacent holes in the reception area, R'r1, R'r2 and R'r3 are the signal transmitting lines in the reception area, and M'r12 and M'r23 are the electromagnetic coupling values between adjacent holes in the reception area.

The conductive pattern 430 acts as a means for giving a capacitance C'r2 to the resonator R'r2 within the reception area. Due to the capacitance C'r2 added to the resonator R'r2, it is possible for the duplexer dielectric filter to accomplish a desired reduction ratio at a low frequency band within the reception area, thus improving the signal filtering effect of the duplexer dielectric filter. The value of the capacitance is controllable by changing the length of the conductive pattern 430 of FIG. 6A. That is, a capacitance is formed between the conductive pattern 430 and the resonating holes 407 of the reception area in accordance with the overlapped structure of the conductive pattern 430 and the resonating holes 407, thus finally forming the desired capacitance C'r2. The value of the capacitance C'r2 is changed in accordance with the distance between the conductive pattern 430 of the open area 425 and the conductive patterns 409 around the resonating holes 407. That is, the value of the capacitance C'r2 is increased in proportion to the distance between the conductive pattern 430 of the open area 425 and the conductive patterns 409 around the resonating holes 407.

In the fourth embodiment of the present invention, it is possible to form two or more conductive patterns 430 on the dielectric block 401. In addition, the shape of the open area 425 is not limited. That is, the conductive pattern 430 of the fourth embodiment may be formed on an open area having any shape in addition to the shapes shown in FIGS. 3, 4*a* and 4*b* without affecting the functioning of this invention.

As described above, the present invention provides a duplexer dielectric filter having an open area free from a conductive layer on the side surface of a dielectric block within a reception area, thus forming a desired loading capacitance and a desired coupling capacitance. Therefore, it is possible to achieve the desired filtering characteristics even with small-sized duplexer dielectric filters. In addition, a conductive pattern, having a predetermined size, is formed on the open area, thus adding an attenuation pole in the reception area of the duplexer dielectric filter. This improves the operational performance of the resulting duplexer dielectric filter.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A duplexer dielectric filter, comprising:

a dielectric block having an upper surface, a lower surface, and a side surface, with a conductive material coated on at least a part of the lower and side surfaces;

a reception area for filtering signals received by the filter, said reception area including a plurality of resonators each of which has a first resonating hole, said first resonating holes completely extending from the upper surface to the lower surface of said dielectric block and being at least partially coated with a conductive material on the internal surface thereof;

a transmission area for filtering signals to be transmitted, said transmission area including a plurality of resonators each of which has a second resonating hole, said second resonating holes completely extending from the upper surface to the lower surface of said dielectric block and being at least partially coated with a conductive material on the internal surface thereof;

reception and transmission terminals for accomplishing signal reception and transmission operation, said reception and transmission terminals respectively comprising an electrode area insulated from the conductive material coated on the side surface of the dielectric block;

an antenna terminal arranged between said first and second filtering areas and comprising an electrode area insulated from the conductive material coated on the side surface of the dielectric block; and a first open area disposed on said side surface of the dielectric block only at a position within the reception area while being free from a conductive material and connected to a conductive material free open area of the upper surface, said first open area controlling both a coupling capacitance and a loading capacitance of at least one of the resonators within the reception area, which is adjacent thereto.

2. The duplexer dielectric filter according to claim 1, wherein said reception terminal, transmission terminal and antenna terminal are insulated from the conductive material disposed on the side surface of the dielectric block by a second open area.

3. The duplexer dielectric filter according to claim 1, wherein said coupling capacitance and loading capacitance of at least one of the resonators within the reception area are changed in accordance with a size of said first open area.

4. The duplexer dielectric filter according to claim 2, wherein said first and second open areas are integrated with each other.

5. The duplexer dielectric filter according to claim 2, wherein said first and second open areas are isolated from each other.

6. The duplexer dielectric filter according to claim 1, further comprising at least a third open area disposed on another part of said side surface of the dielectric block at a position corresponding to the reception area while being free from a conductive material, said at least a third open area controlling both a coupling capacitance and a loading capacitance of at least one of said resonators within the reception area, which is adjacent thereto.

7. The duplexer dielectric filter according to claim 1, further comprising at least one conductive pattern, said conductive pattern being disposed on said dielectric block within the first open area, with an additional capacitance formed between said conductive pattern and at least one first resonating hole of the first open area, thus forming an attenuation pole.

8. The duplexer dielectric filter according to claim 7, wherein said conductive pattern is disposed within the reception area.

9. The duplexer dielectric filter according to claim 7, wherein said additional capacitance is changed in accordance with a length of said conductive pattern within the reception area.

10. The duplexer dielectric filter according to claim 7, wherein said additional capacitance is changed in accordance with a distance between said conductive pattern and at least one first resonating hole within the reception area.

11. A duplexer dielectric filter, comprising:

a dielectric block having an upper surface, a lower surface, and a side surface, with a conductive material coated on at least a part of the lower and side surfaces;

a reception area for filtering a received signal, said reception area comprising a resonator including a first resonating hole, said first resonating hole completely extending from the upper surface to the lower surface of said dielectric block while being at least partially coated with a conductive material on the internal surface thereof;

a transmission area for filtering a signal to be transmitted, said transmission area comprising a resonator including a second resonating hole, said second resonating hole completely extending from the upper surface to the lower surface of said dielectric block while being at least partially coated with a conductive material on the internal surface thereof;

a transmission terminal for accomplishing a signal transmission operation, said transmission terminal comprising an electrode area formed on the upper and side surfaces of the dielectric block at a position corresponding to the transmission area while being insulated from the conductive material coated on the side surface of the dielectric block;

a reception terminal for accomplishing a signal reception operation, said reception terminal comprising an electrode area formed on the upper and side surfaces of the block a position corresponding to the reception area while being insulated from the material coated on the side surface of the dielectric block;

an antenna terminal arranged between said reception and transmission areas and comprising an electrode area insulated from the conductive material coated on the side surface of the electric block; and an open area disposed on said side surface of the dielectric block only at a position within area while being free from a conductive material and connected to a conductive material free open area of the upper surface, said open area controlling both a coupling capacitance and a loading capacitance of the resonator within the reception area.

* * * * *